United States Patent [19]

Anderson

[11] Patent Number: 4,789,104

[45] Date of Patent: Dec. 6, 1988

[54] HIGH PRESSURE COAXIAL FLOW NOZZLES

[75] Inventor: Arthur A. Anderson, St. Paul, Minn.

[73] Assignee: Specialty Manufacturing Co., St. Paul, Minn.

[21] Appl. No.: 583,374

[22] Filed: Feb. 24, 1987

[51] Int. Cl.[4] ..... B05B 1/26; B05B 15/04

[52] U.S. Cl. ..... 239/455; 239/441; 239/457; 239/546; 239/590.3

[58] Field of Search ..... 239/437–441, 239/444, 458, 546, 455, 457, 590.3

[56] References Cited

U.S. PATENT DOCUMENTS

| | | | |
|---|---|---|---|
| 641,933 | 1/1900 | Canner | 239/441 |
| 705,754 | 7/1902 | Harris | 239/441 |
| 2,790,680 | 4/1957 | Rosholt . | |
| 2,959,359 | 11/1960 | Casaletto | 239/546 X |
| 3,550,861 | 12/1970 | Tesom | 239/546 |
| 3,558,061 | 1/1971 | Hansen . | |
| 3,811,369 | 5/1974 | Ruegg | 239/437 X |
| 3,982,698 | 9/1976 | Anderson . | |
| 4,095,747 | 6/1978 | Anderson . | |
| 4,141,504 | 2/1979 | Anderson . | |

FOREIGN PATENT DOCUMENTS

| | | | |
|---|---|---|---|
| 904593 | 2/1982 | U.S.S.R. | 239/546 |

*Primary Examiner*—Andres Kashinkow
*Assistant Examiner*—Mary Beth O. Jones
*Attorney, Agent, or Firm*—Jacobson and Johnson

[57] ABSTRACT

A high pressure spray nozzle is provided having a central fluid stream that can be converted to a fan shaped fluid stream by rotation of a housing cap. Rotation of a second portion of the housing produces a cone shaped fluid stream which is coaxial with the central fluid stream.

1 Claim, 1 Drawing Sheet

HIGH PRESSURE COAXIAL FLOW NOZZLES

BACKGROUND OF THE INVENTION

1. Field of the Invention

This invention is generally related to nozzles and, more specifically, to high pressure nozzles for producing a spray flow pattern ranging from a single coherent stream to a fan shaped spray with a surrounding coaxial cone shaped spray pattern.

2. Description of the Prior Art

High pressure nozzles are well known in the art. Typical of such high pressure nozzles are those shown in my U.S. Pat. No. 4,141,504 and the art cited therein. The concept of a high pressure nozzle having a safe and effective indexing means to produce at least two different spray patterns are also known in the art. However, most of the prior art two flow nozzles are very bulky or have features which make them either hazardous to use or difficult to adjust when operating with fluid pressure in excess of 500 psi. Typically, constant volume pumps are used to supply the high pressure fluid for use with high pressure nozzles.

The present invention provides a small, compact nozzle which, by partial rotation of the nozzle, changes the fluid stream from a high pressure central jet to a fan spray and by rotation of a second portion of the nozzle produces a cone shaped spray that is coaxial with the central fluid stream which can be used to aspirate soap or other fluids through the nozzle.

SUMMARY OF THE INVENTION

Briefly, the present invention comprises an improvement to high/low pressure nozzles in which a central high pressure fluid stream can be converted from a single coherent fluid stream to a fan shaped or diverging stream by rotation of a portion of the nozzle and a coaxial cone shaped stream of fluid can be directed around the central fluid stream by rotation a further portion of the nozzle thereby permitting the nozzle to produce two fluid streams, a central fluid stream and a secondary conical fluid stream which is coaxial with the central fluid stream.

DESCRIPTION OF THE PREFERRED EMBODIMENT

Figure 1:
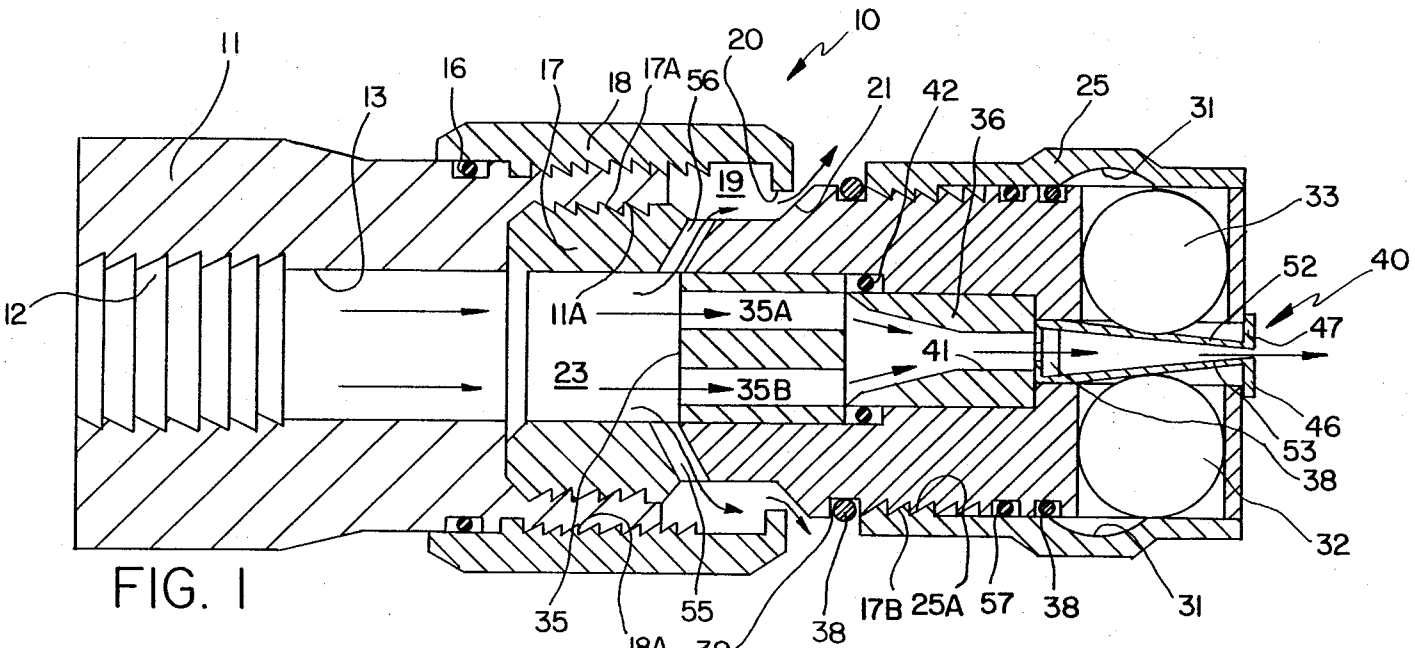
FIG. 1 is a cross sectional view of my nozzle.

Referring to the drawing, FIG. 1 shows a cutaway view of my nozzle which is designated by reference numeral 10. Nozzle 10 comprises a first body member 11 and a second rotatable body member 18 which extends over and rotationally engages a portion of body member 11 through, a set of female threads 18*a*. Body member 11 is adapted to be connected to a source of high pressure fluid and contains a central fluid flow passage 13 for receiving a high pressure fluid. Located on one end of body member 11 is a threaded section 12 for engaging a source of high pressure fluid. Located threadingly attached to the opposite end of body member 11 is a body member 17 having a central flow passage 23 and a set of radially extending fluid passages 55 and 56 which are in fluid communication with an annular fluid chamber 19 formed between body member 18 and body member 17. Body member 17 is held in internal contact with body member 11 through a set of male threads 17*a* which are located on the outer periphery of body member 17 and a set of female threads 11*a* which are located in body member 11. Located in passage 23 of body member 17 is a flow straightener 35 having a plurality of parallel spaced fluid passages 35*a* and 35*b* and a converging nozzle insert 36 located downstream of flow straightener 35. The purpose of flow straightener 35 is to viscously damp out turbulence and eddies in the fluid stream. The converging nozzle 36 is for smoothly converging the separate fluid streams from the flow straightener into a single cohesive fluid stream. Nozzle insert 36 has been made as a separate portion from body member 17 but could also be made from the same material as body member 17. Typically, nozzle insert 36 and flow straightener 35 may be press-fit or threaded into body member 17. A flexible sealing ring such as an O ring 42 is located around the outer periphery of nozzle insert 36 to prevent back flow around the outside of nozzle insert 36.

Figure 2:
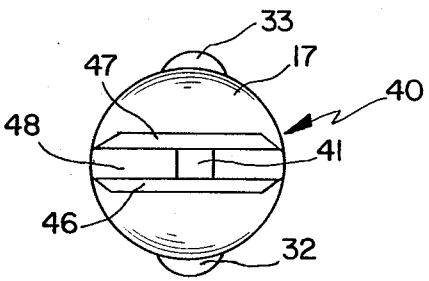
FIG. 2 is an end view of a flexible member located in my nozzle.

Connected to the nozzle end of body member 17 is a housing cap 25 which can be rotationally displaced axially in either direction through rotation of housing cap 25 with respect to body member 17 through male threads 17*b* and female threads 25*a*. Located inside of housing cap 25 is a first solid sphere 32 and a second solid sphere 33. Spheres 32 and 33 are typically made of steel or the like. Located between spheres 32 and 33 is a U-shaped resilient member 40. Resilient member 40 which is preferably made of spring steel or the like is also shown in an end view in FIG. 2. Referring to FIG. 1 and FIG. 2, member 40 comprises a bottom section 48 with a fluid opening 41 therein, an elongated flat side 52 which terminates in an upward projection lip 47 and an elongated flat side 53 which terminates in a downward projection lip 46. Member 40 is made from a resilient material so that in normal condition sphere 32 and 33 are forced outward by the flat side 52 and flat side 53.

Located around the inner periphery of housing cap 25 is an annular arcuate shaped chamber 31 which has sufficient arc so that when housing cap 25 is rotated and displayed outward spheres 33 and 32 can be forced into the arcuate shaped chamber 31 by resilient member 40. FIG. 2 is an end view without cap 25 of member 17 showing resilient member 40 forcing spheres 32 and 33 to project outward from member 17. With spheres 32 and 33 in the extended condition the central opening 41 which in FIG. 2 is shown as square shaped, permits a single coherent fluid stream to emanate from opening 41 without impediment by flat sections 52 and 53. The condition occurs when cap 25 is on member 17 and the spheres are seated in the annular arcuate chamber 36. However, when member 40 is compressed by spheres 33 and 32 as shown in FIG. 1, the fluid stream emanating from opening 41 is pinched flat or widened out by flat side 52 and 53 to form a stream of fluid that fans out in proportion to the spacing between top flat 52 and bottom flat 53. That is, the close the spacing of flat members 42 and 53 the wider the angle of spray pattern emanating from nozzle 10.

Another feature of valve 10 is the conical spray pattern that can be directed from the central body of valve 10. FIG. 1 shows valve 10 in the mode in which spray is directed radially outward from the center of valve 10.

Note, central chamber 23 connects to passages 55 and 56 to an annular chamber 19. Located at the front of annular chamber 19 and on member 18 is an annular lip 20 which extends around the outside of member 17. Annular lip 20 is shown in FIG. 1 as extending around and being spaced from an annular beveled surface 21 which is located on housing 17. In operation of valve 10 in the central spray mode and with members 20 and 21 spaced apart as shown in FIG. 1 a portion of the high pressure fluid entering passage 23 flows outward through passage 55 and 56 and into annular chamber 19 where it is forced between annular lip 20 and annular surface 21 in the form of a conical spray. When the high pressure nozzle is used to wash objects with a detergent or the like this secondary conical spray is particularly useful for rinsing.

The amount of fluid emanating from between annular lip 20 and annular beveled surface 26 is controlled by rotating member 18 with respect to member 11. That is, rotation of member 18 in one direction closes the gap between annular lip 20 and annular surface 21 thereby decreasing the flow area and rotation of member 18 in the opposite direction opens the spacing between lip 20 and surface 21 thereby increasing the flow area therethrough. The arrows on the drawing generally indicate the direction of fluid flow through my nozzle.

Figure 3:
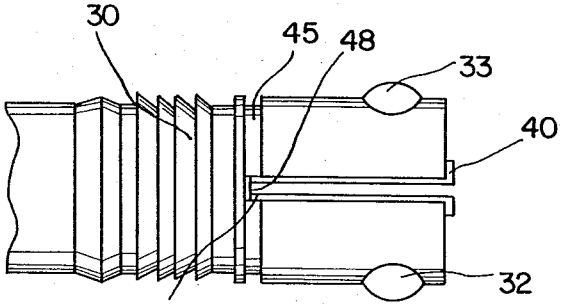
FIG. 3 is a side view of the nozzle without a front housing cap.
Figure 4:
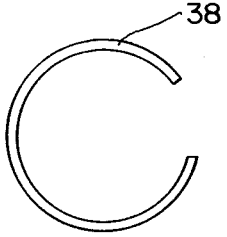
FIG. 4 is a front view of a retaining ring.

Since my nozzles are used with high pressure fluid, I provide certain features to prevent operator injury. For example, in order to prevent cap 25 from accidentally being closed too tight, I provide a retaining ring 38 (also FIG. 4) which fits in an annular recess 39 in member 17. That is, the rear of housing cap will abut against retaining member 38 to prevent further axial displacement of cap 25. Similarly, in order to ensure that member 40 is held in place in nozzle 10 and not forced out by the fluid stream, I use a second retaining ring 38 in the recess 45 (FIG. 1 and FIG. 3) which engages the back portion 48 of member 40 to hold member 40 in valve 10. A notch 56 on the edge of flats 52 and 53 and a similar notch, not shown, on the opposite side of member 40 permit retaining ring 38 to hold member 40 in position in nozzle 10 .

A further feature of rotation of the second portion of the nozzle is that with a constant volume of flow through the nozzle the generation of the second stream of fluid (by increasing the nozzle discharge outlet area) reduces the fluid pressure in the nozzle. The reduction of fluid pressure in the nozze can be used to aspirate soap or other fluids through the nozzle.

I claim:

1. A high pressure nozzle for varying the flow pattern of a fluid emanating therefrom, wherein said nozzle has a nozzle opening through which fluid flows comprising:

a body member having a passage for fluid to flow therethrough;

a resilient member located in said body member, said resilient member having surface means comprising opposed, substantially flat surfaces which are deformable to form an open path that smoothly converges in the direction away from said nozzle opening for shaping the flow pattern of fluid through said nozzle wherein the width of said surface means is wider than the width of said nozzle opening and means for forcing said resilient member into the fluid flowing through said nozzle so that a fluid stream emanating from said passage can be formed into a wider stream.

* * * * *